US007824071B2

(12) United States Patent
Zheng

(10) Patent No.: US 7,824,071 B2
(45) Date of Patent: Nov. 2, 2010

(54) LED LAMP INCLUDING MOUNTING PLATES WITH INCLINED PORTIONS

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 114 days.

(21) Appl. No.: 12/241,058

(22) Filed: Sep. 30, 2008

(65) Prior Publication Data

US 2009/0323327 A1 Dec. 31, 2009

(30) Foreign Application Priority Data

Jun. 25, 2008 (CN) ..... 2008 1 0068105

(51) Int. Cl.
*F21S 4/00* (2006.01)
*F21S 8/04* (2006.01)

(52) U.S. Cl. ..... 362/249.02; 362/249.06; 362/97.3; 362/145; 362/249.11

(58) Field of Classification Search ..... 362/145, 362/249.02, 249.06, 249.11, 97.3
See application file for complete search history.

(56) References Cited

U.S. PATENT DOCUMENTS

| | | | | |
|---|---|---|---|---|
| 6,241,373 | B1 * | 6/2001 | Kelley et al. | 362/249.02 |
| 6,431,728 | B1 * | 8/2002 | Fredericks et al. | 362/249.06 |
| 6,578,979 | B2 * | 6/2003 | Truttmann-Battig | 362/249.06 |
| 6,942,361 | B1 * | 9/2005 | Kishimura et al. | 362/249.06 |
| 7,152,997 | B1 * | 12/2006 | Kovacik et al. | 362/249.02 |
| 7,654,691 | B2 * | 2/2010 | Liu et al. | 362/249.02 |
| 7,654,701 | B2 * | 2/2010 | Zhang et al. | 362/249.02 |
| 7,665,862 | B2 * | 2/2010 | Villard | 362/249.02 |
| 2009/0135599 | A1 * | 5/2009 | Lin et al. | 362/249.02 |
| 2009/0154172 | A1 * | 6/2009 | Zheng et al. | 362/373 |
| 2009/0244894 | A1 * | 10/2009 | Zhou et al. | 362/249.02 |
| 2009/0296386 | A1 * | 12/2009 | Wang et al. | 362/249.02 |
| 2010/0002438 | A1 * | 1/2010 | Zhang et al. | 362/249.02 |

* cited by examiner

*Primary Examiner*—Ismael Negron
(74) *Attorney, Agent, or Firm*—Frank R. Niranjan

(57) ABSTRACT

An LED lamp includes a connecting box with a retaining assembly attached to its underside and a plurality of LED modules mounted on the retaining assembly. The retaining assembly is a plurality of spaced mounting plates with two lateral portions extending laterally beyond other, lower mounting plates. The LED modules are mounted on undersides of the lateral portions of the mounting plates.

19 Claims, 3 Drawing Sheets

LED LAMP INCLUDING MOUNTING PLATES WITH INCLINED PORTIONS

BACKGROUND OF THE INVENTION

1. Field of the Invention

The disclosure relates to an LED lamp, and more particularly to an improved LED lamp capable of illuminating a large area.

2. Description of Related Art

An LED lamp utilizes light-emitting diodes (LEDs) as a source of illumination, in which current flowing in one direction through a junction region comprising two different semiconductors results in electrons and holes coupling at the junction region and generating a light beam. The LED is resistant to shock and has an almost endless lifetime under specific conditions, making it a popular cost-effective and high quality replacement for incandescent and fluorescent lamps.

Known implementations of LED modules in an LED lamp make use of a plurality of individual LEDs to generate light that is ample and of satisfactory spatial distribution. The large number of LEDs, however, increases price and power consumption of the module. Considerable heat is also generated, which, if not adequately addressed at additional expense, impacts LED lamp reliability.

Further, since the LEDs are generally arranged on a printed circuit board having a flattened surface, illumination is distributed at a wide variety of spatial angles with sharp differences in intensity and brightness, making it unsuitable for environments requiring even and broad illumination.

What is needed, therefore, is an LED lamp which can overcome the limitations described.

SUMMARY OF THE INVENTION

An LED lamp includes a connecting box, a retaining assembly attached to an underside of the connecting box, and a plurality of LED modules mounted on the retaining assembly. The retaining assembly includes a plurality of spaced mounting plates, each of which includes two lateral portions extending laterally beyond other mounting plates located thereunder. The LED modules are mounted on undersides of the lateral portions of the mounting plates.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
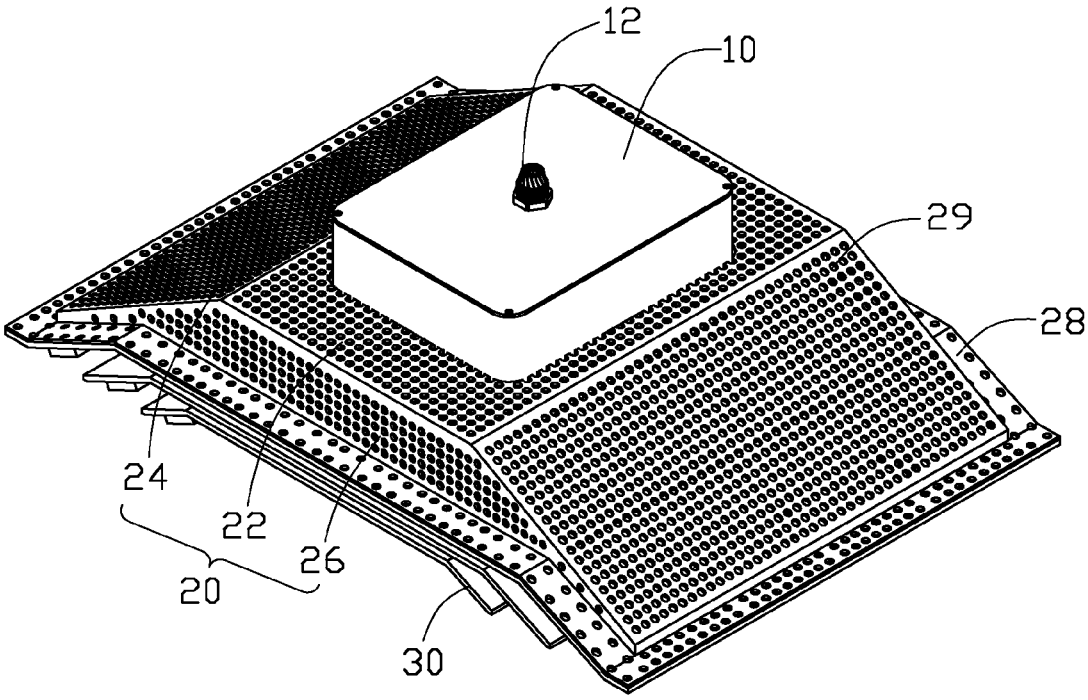
FIG. 1 is an isometric, assembled view of an LED lamp in accordance with a preferred embodiment of the disclosure.
Figure 2:
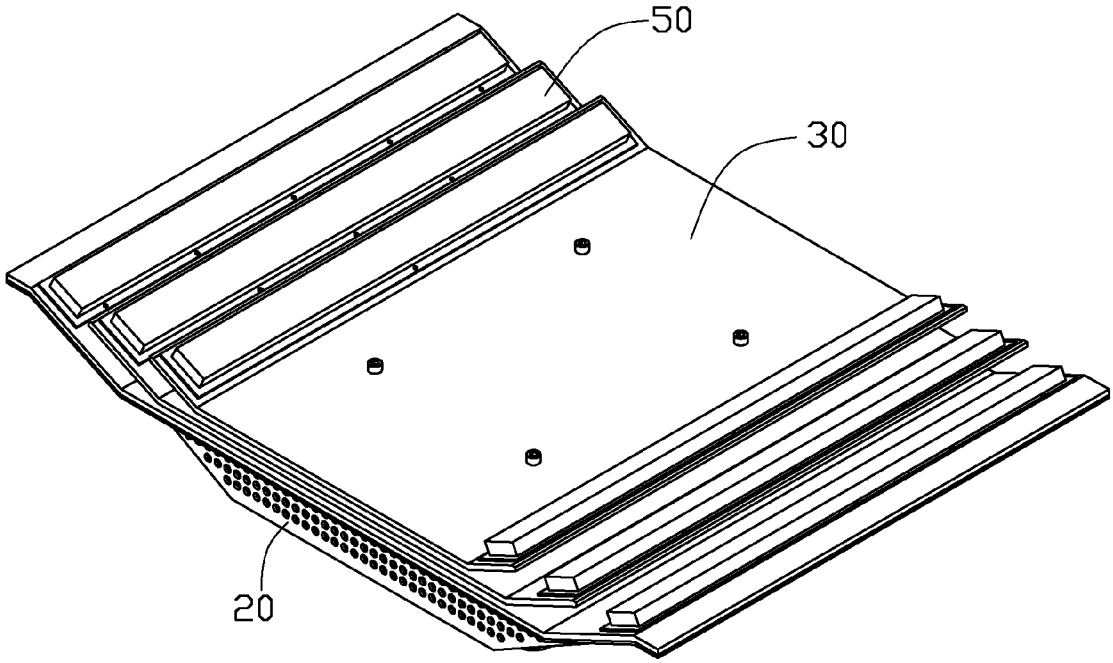
FIG. 2 is an inverted view of FIG. 1.
Figure 3:
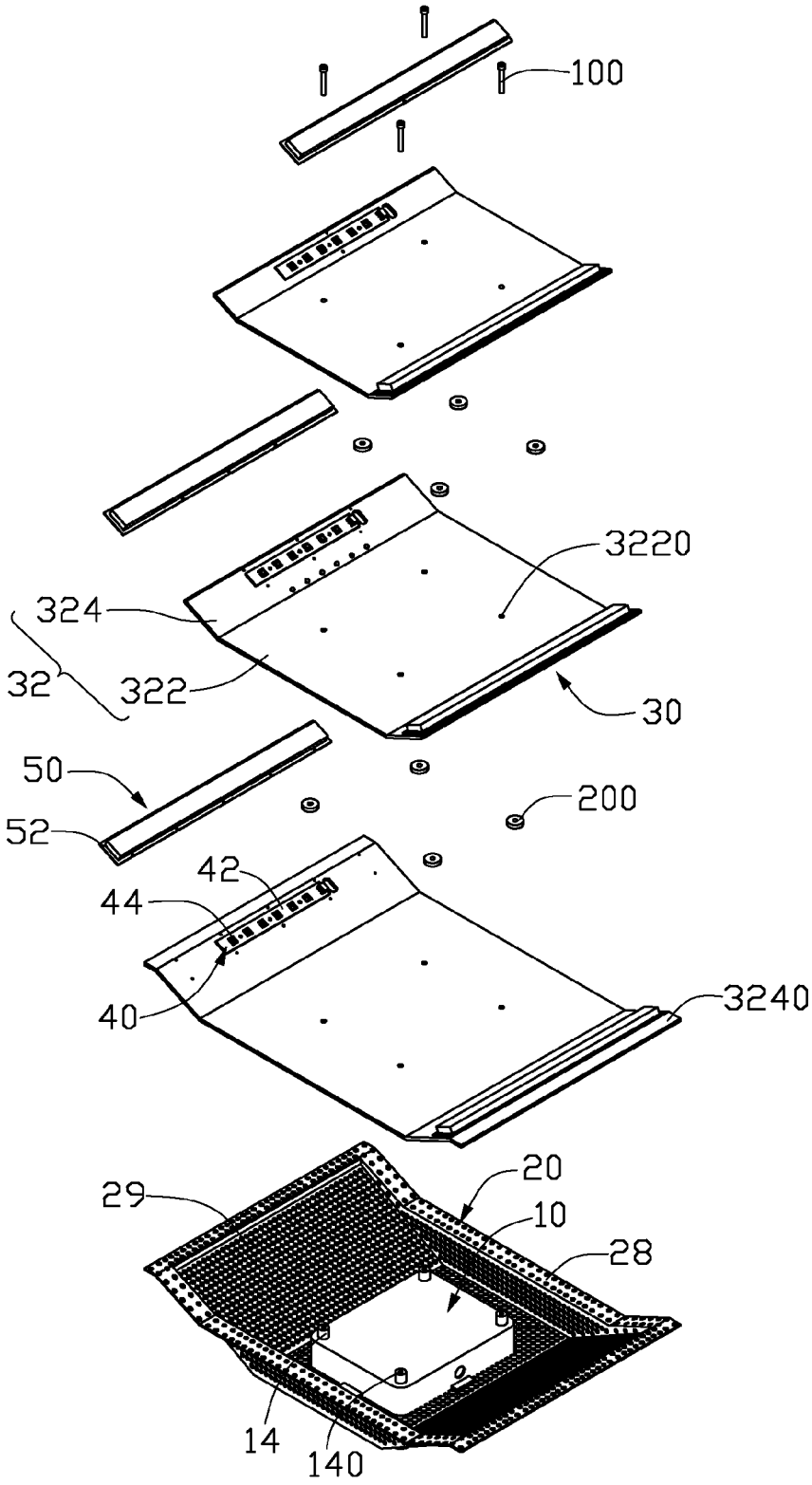
FIG. 3 is an exploded view of FIG. 2.

Referring to FIGS. 1-3, an LED lamp in accordance with a preferred embodiment is illustrated. The LED lamp, which is configured for providing illumination indoors and out, includes a lampshade 20, a connecting box 10 embedded in the lampshade 20, a retaining assembly 30, a plurality of LED modules 40 fixed to an underside surface of the retaining assembly 30, and a plurality of lamp covers 50 respectively covering the LED modules 40.

The lampshade 20 covers the retaining assembly 30 and comprises a rectangular top plate 22, two wing plates 24 extending obliquely and outwardly from two opposite long sides of the top plate 22, and two side plates 26 extending perpendicularly from two opposite short sides of the top plate 22 and interconnecting the top plate 22 and the wing plates 24. The top plate 22 defines a rectangular receiving hole in a central portion thereof engagingly receiving the connecting box 10 therein. A continuous flange 28 surrounding the lampshade 20 extends outwardly and horizontally from underside edges of the wing plates 24 and the side plates 26. The lampshade 20 defines a plurality of air holes 29 therein, densely distributed all over the lampshade 20, allowing air circulation.

The connecting box 10 is a cube, inlayed in the lampshade 20 and attached to the top plate 22 with two equal parts located at two opposite sides of the lampshade 20. The connecting box 10 comprises a top panel parallel to the top plate 22 of the lampshade 20, an underside panel parallel to the top panel and four sidewalls interconnecting the top and underside panels. The four sidewalls are perpendicular to the top plate 22 and provided with engaging members (not labeled) on a central portion thereof, engaging an underside of the top plate 22 to securely fix the connecting box 10 and the lampshade 20 together. A mounting member 12 is provided in a centre of the top panel of the connecting box 10 connecting with a hanger (not shown) to mount the LED lamp when in use. The connecting box 10 has four retaining posts 14 extending downwardly from four corners of the underside panel thereof. Each of the retaining posts 14 defines a fixing hole 140 therein for engagingly receiving a fixture 100 which extends through the retaining assembly 30.

The retaining assembly 30 is fixed to the underside panel of the connecting box 10 and comprises a plurality of overlapping mounting plates 32. The mounting plates 32 each are integrally formed of a metallic sheet with effective heat conductivity such as aluminum or copper, the plates 32 being rectangular in orthogonal projection and including a rectangular horizontal part 322 parallel to the top plate 22 of the lampshade 20, and two lateral portions at two lateral sides of the horizontal part 322 and to the undersides of the two lateral portions the LED modules 40 are attached. In this embodiment, the two lateral portions are two inclined members or parts 324 extending outwardly and downwardly from two opposite lateral sides of the horizontal part 322. The horizontal part 322 of each of the mounting plates 32 is located just under the underside panel of the connecting box 10 and defines four extending holes 3220 respectively in alignment with the four fixing holes 140 of the retaining posts 14 of the connecting box 10, through which the fixtures 100 extend upwardly to engage the four corresponding fixing holes 140. The horizontal parts 322 are all larger than the underside panel of the connecting box 10. The mounting plates 32 gradually decrease in length from a top, adjacent to the connecting box 10, toward a bottom, away from the connecting box 10. Correspondingly, the horizontal parts 322 and the inclined parts 324 gradually decrease in width from a top, adjacent to the connecting box 10, toward a bottom, away from the connecting box 10. Accordingly, the inclined parts 324 of the upper mounting plate 32 extend laterally beyond the lower mounting plates 32. The two inclined parts 324 are oriented at a sharp angle relative to the horizontal part 322 and symmetrical with each other relative to the horizontal part 322 of the mounting plate 32. The top mounting plate 32 includes two engaging flanges 3240 extending outwardly and horizontally from two opposite lateral edges of the inclined members 324 thereof. The engaging flanges 3240 snugly couple to corresponding portions of the flange 28 of the lampshade 20.

The LED modules 40 each comprise an elongated printed circuit board 42 and a plurality of LED components 44 linearly arranged thereon, along a length thereof. Each of the LED modules 40 is attached to an underside surface of the inclined part 324 of the mounting plate 32 and arranged along the lateral edge thereof. Furthermore, the lampshade 20 is made of a material with effective heat conductivity, assisting mounting plate 32, adjoining thereto to dissipate heat generated by the LED modules 40.

The lamp covers 50 are elongated and transparent/translucent plastic or glass, each covering one of the LED modules 40 with an opening theretoward and a fixing flange 52 extending outwardly from an upper edge thereof and surrounding the opening. The fixing flange 52 is adhered to the underside surface of the inclined part 324 of the mounting plate 32 and surrounding the LED module 40 to retain the lamp cover 50 thereon.

In assembly of the LED lamp, the fixtures 100 extending upwardly through the extending holes 3220 of the overlapping mounting plates 32 in sequence are engagingly received in the fixing holes 140 of the connecting box 10. A plurality of gaskets 200 on the fixtures 100 are respectively sandwiched between the two horizontal parts 322 of every two neighboring mounting plates 32, providing separation thereof by a predetermined distance. The inclined parts 324 on a same lateral side of the horizontal parts 322 are parallel and arranged to half-overlap.

In use, none of the LED modules 40 mounted on the underside surface of the inclined parts 324 of one of the mounting plates 32 are obstructed by other mounting plates 32; moreover, the overlapping mounting plates 32, located on different levels, allow light generated by the LED modules 40 at different levels to be respectively directed to different orientations of the LED lamp and evenly distributed without. The LED lamp is thus able to meet a specified requirement of use. Further, each of the mounting plates 32 has a surface area sufficiently broad to dissipate heat from the LED modules 40 mounted thereon.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a connecting box;

a retaining assembly attached to an underside of the connecting box and comprising a plurality of mounting plates spaced from each other, each of the mounting plates having two lateral portions extending laterally beyond other mounting plates located thereunder;

a plurality of LED modules mounted on undersides of the lateral portions of the mounting plates; and a lampshade covering the mounting plates and surrounding the connecting box, the lampshade having a top plate, two wing plates extending obliquely and outwardly from two opposite long sides of the top plate, and two side plates extending perpendicularly from two opposite short sides of the top plate and interconnecting the top plate and the wing plates.

2. The LED lamp as claimed in claim 1, further comprising a plurality of lamp covers respectively covering the LED modules, each comprising an opening and a fixing flange extending outwardly from an upper edge thereof and surrounding the opening and fixed to a corresponding underside of the lateral portions of the mounting plates.

3. The LED lamp as claimed in claim 1, wherein the mounting plates are parallel to each other and gradually decrease in length between two lateral edges of the two lateral portions from the top, adjacent to the connecting box toward the bottom, away from the connecting box.

4. The LED lamp as claimed in claim 3, wherein the two lateral portions of the mounting plates are bent obliquely and downwardly.

5. The LED lamp as claimed in claim 1, wherein the lampshade defines a receiving hole in the top plate engagingly receiving the connecting box and comprises a continuous flange surrounding the lampshade and extending outwardly and horizontally from underside edges of the wing plates and side plates, joining top surfaces of edge portions of one of the mounting plates.

6. The LED lamp as claimed in claim 5, wherein the lampshade defines a plurality of air holes densely distributed thereon, facilitating air circulation and engaging middle portions of the circumference of the connecting box to couple the lampshade and connecting box together.

7. The LED lamp as claimed in claim 1, wherein each of the mounting plates comprises a horizontal part, and the two lateral portions extend downwardly and outwardly from two opposite lateral sides of the horizontal part to become two inclined parts.

8. The LED lamp as claimed in claim 7, wherein the horizontal parts are parallel and the inclined parts gradually decrease in width from the top, adjacent to the connecting box, toward the bottom, away from the connecting box, the inclined parts of an upper mounting plate extending laterally beyond other lower mounting plates.

9. The LED lamp as claimed in claim 7, wherein the inclined parts on a same lateral side of the horizontal parts are parallel to each other and half-overlap.

10. The LED lamp as claimed in claim 9, wherein a plurality of fixtures comprising gaskets extends through the mounting plates and engages the underside of the connecting box, with the gaskets sandwiched between every two neighboring mounting plates to maintain spacing therebetween.

11. An LED lamp, comprising:

a connecting box;

a retaining assembly attached to an underside of the connecting box and comprising a plurality of mounting plates spaced from each other, each of the mounting plates having a horizontal part and two inclined parts extending from two opposite lateral sides of the horizontal part beyond other mounting plates located thereunder; and a plurality of LED modules mounted on undersides of the inclined parts of the mounting plates;

wherein a plurality of fixtures comprising gaskets extend through the mounting plates and engage the underside of the connecting box and are sandwiched between every two neighboring mounting plates to maintain spacing therebetween.

12. The LED lamp as claimed in claim 11, wherein the mounting plates are parallel and gradually decrease in length between two lateral edges of the two inclined parts from the top, adjacent to the connecting box, toward the bottom, away from the connecting box.

13. The LED lamp as claimed in claim 11, wherein the two inclined parts of each of the mounting plates are bent obliquely, downwardly, and symmetrical with each other relative to each of the mounting plates.

14. The LED lamp as claimed in claim 11, wherein the inclined parts on a same lateral side of the horizontal parts are parallel and half-overlap.

15. The LED lamp as claimed in claim 11, wherein the horizontal parts are parallel and the inclined parts gradually decrease in width from the top, adjacent to the connecting box, toward the bottom, away from the connecting box, and the inclined parts of an upper mounting plate extend laterally beyond the other mounting plates.

16. An LED lamp, comprising:

a connecting box;

a retaining assembly attached to an underside of the connecting box and comprising a plurality of mounting plates spaced from each other, each of the mounting plates having two lateral portions extending laterally beyond other mounting plates located thereunder;

a plurality of LED modules mounted on undersides of the lateral portions of the mounting plates; and a plurality of lamp covers respectively covering the LED modules, each lamp cover comprising an opening and a fixing flange extending outwardly from an upper edge thereof and surrounding the opening and fixed to a corresponding underside of the lateral portions of the mounting plates.

17. The LED lamp as claimed in claim 16, wherein each of the mounting plates comprises a horizontal part, and the two lateral portions extend downwardly and outwardly from two opposite lateral sides of the horizontal part to become two inclined parts.

18. The LED lamp as claimed in claim 16, wherein the mounting plates are parallel to each other and gradually decrease in length between two lateral edges of the two lateral portions from the top, adjacent to the connecting box toward the bottom, away from the connecting box.

19. The LED lamp as claimed in claim 18, wherein the two lateral portions of the mounting plates are bent obliquely and downwardly.

* * * * *